US009648710B2

(12) United States Patent
Smith et al.

(10) Patent No.: US 9,648,710 B2
(45) Date of Patent: May 9, 2017

(54) HIGH POWER X-RAY TUBE HOUSING

(71) Applicant: Varian Medical Systems, Inc., Palo Alto, CA (US)

(72) Inventors: David Craig Smith, Herriman, UT (US); Gregory Andrews, Draper, UT (US); Owen D. Brimhall, South Jordan, UT (US); Anson Cole Chamberlain, American Fork, UT (US)

(73) Assignee: VAREX IMAGING CORPORATION, Salt Lake City, UT (US)

( * ) Notice: Subject to any disclaimer, the term of this patent is extended or adjusted under 35 U.S.C. 154(b) by 279 days.

(21) Appl. No.: 14/446,897

(22) Filed: Jul. 30, 2014

(65) Prior Publication Data

US 2015/0139404 A1 May 21, 2015

Related U.S. Application Data

(60) Provisional application No. 61/906,256, filed on Nov. 19, 2013.

(51) Int. Cl.

| | |
|---|---|
| ***H01J 35/00*** | (2006.01) |
| ***H05G 1/02*** | (2006.01) |
| ***H01J 35/16*** | (2006.01) |

(52) U.S. Cl.

CPC ..... *H05G 1/025* (2013.01); *H01J 35/16* (2013.01); *H01J 2235/125* (2013.01)

(58) Field of Classification Search

CPC ..... H01J 2235/1283; H01J 2235/125

See application file for complete search history.

(56) References Cited

U.S. PATENT DOCUMENTS

| | | | | |
|---|---|---|---|---|
| 4,355,410 | A * | 10/1982 | Sullins | H05G 1/025 378/199 |
| 6,400,799 | B1 | 6/2002 | Andrews | |
| 7,236,571 | B1 * | 6/2007 | Kendall | H01J 35/16 378/141 |
| 2007/0230663 | A1 * | 10/2007 | Anno | H01J 35/08 378/132 |
| 2009/0225951 | A1 | 9/2009 | Wandke et al. | |

OTHER PUBLICATIONS

International Search Report and Written Opinion mailed Feb. 19, 2015 in related PCT Application No. PCT/US2014/066398 (16 pages).

* cited by examiner

*Primary Examiner* — Danielle Fox

(74) *Attorney, Agent, or Firm* — Maschoff Brennan

(57) ABSTRACT

An x-ray housing can include: a finned housing member having a tubular body with an external fin array on a finned external surface and an internal fin array on a finned internal surface, the finned internal surface defining a finned housing lumen, the internal fin array and external fin array cooperatively forming a heat exchanger; and an apertured housing member having a tubular body with an x-ray window aperture extending therethrough from an external surface to an internal surface, the internal surface defining an apertured housing lumen, the finned housing member having an annular end integrally coupled with an annular end of the apertured housing member to form a tubular x-ray housing having an x-ray housing lumen.

21 Claims, 13 Drawing Sheets

HIGH POWER X-RAY TUBE HOUSING

CROSS-REFERENCE TO RELATED APPLICATIONS

The present application claims the benefit of U.S. Provisional Application No. 61/906,256 filed Nov. 19, 2013, which provisional application is incorporated herein by specific reference in its entirety.

BACKGROUND

X-ray devices are extremely valuable tools that are used in a wide variety of applications such as industrial and medical. For example, such equipment is commonly employed in areas such as medical diagnostic examination, therapeutic radiology, semiconductor fabrication, and materials analysis.

Regardless of the applications in which they are employed, most x-ray devices operate in a similar fashion. X-rays are produced in such devices when electrons are emitted, accelerated, and then impinged upon a material of a particular composition. This process typically takes place within an x-ray tube located in the x-ray device.

The subject matter claimed herein is not limited to embodiments that solve any disadvantages or that operate only in environments such as those described above. Rather, this background is only provided to illustrate one exemplary technology area where some embodiments described herein may be practiced.

SUMMARY

In one embodiment, an x-ray housing can include a finned housing member coupled to an apertured housing member to form the x-ray housing. The finned housing member can have a tubular body with an external fin array on a finned external surface and an internal fin array on a finned internal surface. The finned internal surface can define a finned housing lumen. The internal fin array and external fin array can cooperatively form a heat exchanger. The apertured housing member can have a tubular body with an x-ray window aperture extending therethrough from an external surface to an internal surface. The internal surface can define an apertured housing lumen. The finned housing member can have an annular end integrally coupled with an annular end of the apertured housing member to form a tubular x-ray housing having an x-ray housing lumen formed from the finned housing lumen and apertured housing lumen.

In one embodiment, the external fin array covers the finned external surface between a first end and an un-finned annular region at a second end with a plurality of external fins separated by a plurality of external fin recesses.

In one embodiment, the internal fin array covers the finned internal surface between the first end and an un-finned stator recess and an un-finned annular region at a second end with a plurality of internal fins separated by a plurality of internal finned recesses. In one aspect, the stator recess can extend from the un-finned annular region at the second end of the finned housing to a stator bracket mounted to the finned internal surface between the first end and second end of the finned housing. The stator recess can have a trough into the finned housing that has a depth that is the same or deeper than internal fin recesses of the internal fin array. In one aspect, the stator recess can be positioned partially in the internal fin array and partially in the un-finned annular region at the second end.

In one embodiment, the finned housing can include an end cap recess at the first end on the finned internal surface between a first end annular face and the internal fin array. The end cap recess can be devoid of internal fins and fin recesses and have an end cap located in the end cap recess.

In one embodiment, the apertured housing is devoid of a fin array.

In one embodiment, a second end annular face of the finned housing is integrally coupled with a third end annular face of the apertured housing. The second end annular face of the finned housing has a larger dimension than the third end annular face of the apertured housing. In one aspect, the apertured housing can have a fourth end opposite of the third end, the fourth end having an end cap recess.

In one embodiment, a first plurality of the external fin recesses can have shallower depths compared to a second plurality of the external fin recesses. The first plurality of external fin recesses can be longitudinally aligned with the stator recess. In one aspect, the shallow external fin recesses are about 5% to about 35% of the external fin recesses.

In one embodiment, the x-ray housing can include a shroud covering the finned housing. In one aspect, the shroud includes one or more fan apertures, and each fin aperture can include a fan. In one aspect, the shroud can have a radially bulged region having the one or more fan apertures. In one aspect, the radially bulged region forms an air conduit recess on an internal surface of the shroud.

In one embodiment, an x-ray device can include an x-ray housing as described herein and an x-ray tube having an anode and cathode located in the x-ray housing lumen. In one aspect, the x-ray tube can have an x-ray window aligned with the x-ray window aperture of the apertured housing. In one aspect, the x-ray device can include a fluid coolant in the x-ray housing lumen between the x-ray tube and the internal fin array so as to be in contact therewith.

In one embodiment, a method of cooling an x-ray device can include operating an x-ray device having an x-ray housing and an x-ray tube located in a lumen of the x-ray housing, and operating one or more of the fans in the shroud to blow air over the external fin array so that heat from the fluid coolant in the x-ray housing lumen transfers through the internal fin array through the finned housing to the external fin array and is blown by the air away from the x-ray device to dissipate at least 250 watts of heat. In one aspect, the cooling can dissipate at least 300 watts of heat.

BRIEF DESCRIPTION OF THE FIGURES

The foregoing and following information as well as other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1:
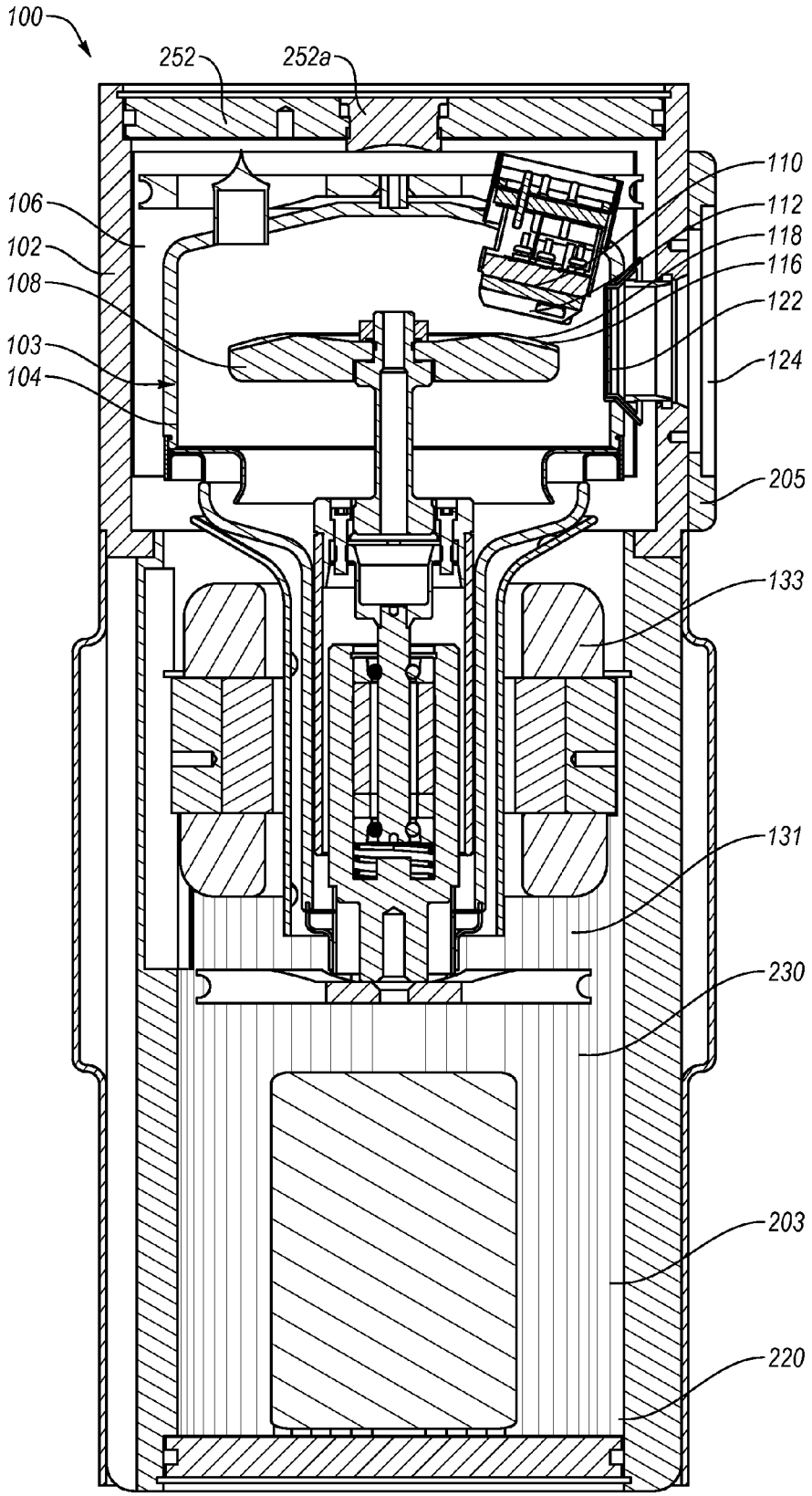
FIG. 1 illustrates a cross-sectional side view of an x-ray device.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Briefly summarized, embodiments presented herein are directed to an x-ray housing of an x-ray device, where the x-ray housing retains an x-ray tube therein. The x-ray tube is positioned within an internal chamber of the x-ray housing that is configured to hold a volume of fluid coolant around the x-ray tube. The x-ray housing is configured with external fins and internal fins to facilitate improved heat transfer of the fluid coolant and the x-ray tube. The x-ray tube includes a vacuum enclosure that contains an anode and cathode. The anode is positioned to receive electrons produced by the cathode within the x-ray tube so that x-rays are generated at the anode and directed out of the vacuum enclosure through an x-ray tube window and out of the x-ray tube. The x-ray housing includes an x-ray housing window positioned relative to and aligned with the x-ray tube window and that is transmissive to the x-rays. The x-ray device also includes a detector array configured to detect x-rays produced by the anode.

The fluid coolant contained in the internal chamber of the x-ray housing can encompass any one of a variety of substances that can be employed in cooling and/or electrically isolating an x-ray device or similar device. Examples of fluids include, but are not limited to, de-ionized water, insulating liquids, and dielectric oils. Often, fluid coolant is used within the x-ray housing internal chamber and circulated around the x-ray tube in order to pull heat from the x-ray tube. The circulation can be passive by temperature-driven fluid flow or active by a fluid pump. The heated fluid coolant can be contained and/or passed through fin recesses in the housing that are thermally associated with internal fins of a heat exchanger region that includes external fins associated with the internal fins in order to cool the heat exchanger region of the housing and fluid coolant.

FIG. 1 is a simplified cross-section depiction of an example x-ray device 100, where the shape, arrangement, and orientation of the features and components may be altered and modified to suit particular operating environments. An x-ray tube housing 102 can include a finned housing 203 with an external fin array 220 and an internal fin array 230, and includes an apertured housing 205 coupled to the finned housing 203. The x-ray device 100 includes the x-ray tube housing 102, within which is positioned an x-ray tube 103 having a vacuum enclosure 104. A fluid coolant 106 is also positioned within the x-ray tube housing 102 and circulates around the x-ray tube 103 having the vacuum enclosure 104 to assist in cooling the x-ray tube 103 and to provide electrical isolation between the x-ray tube 103 and the x-ray tube housing 102. In one embodiment, the fluid coolant 106 comprises dielectric oil, which exhibits acceptable thermal and electrical insulating properties.

Positioned within the vacuum enclosure 104 are a rotating anode 108 and a cathode 110. The anode 108 is spaced apart from and oppositely positioned to the cathode 110, and is at least partially composed of a thermally conductive material. In some embodiments, the anode 108 is at least partially composed of tungsten or a molybdenum alloy. The anode 108 and the cathode 110 are connected within an electrical circuit that allows for the application of a high voltage potential between the anode 108 and the cathode 110. The cathode 110 includes a filament 112 that is connected to an appropriate power source, and during operation, an electrical current is passed through the filament 112 to cause electrons (not shown) to be emitted from the cathode 110 by thermionic emission. The application of a high voltage differential between the anode 108 and the cathode 110 causes the electrons to accelerate from the filament 112 toward a focal track 116 positioned on a target surface 118 of the anode 108. The focal track 116 is typically composed of tungsten or a similar material having a high atomic ("high Z") number. As the electrons accelerate, they gain a substantial amount of kinetic energy, and upon striking the target material on the focal track 116, some of this kinetic energy is converted into electromagnetic waves of very high frequency, which are the x-rays.

The focal track 116 and the target surface 118 are oriented so that emitted x-rays are directed toward an x-ray tube window 122. The x-ray tube window 122 is comprised of an x-ray transmissive material and is positioned along a wall of the vacuum enclosure 104 at a location that is aligned with the focal track 116 and to allow the x-rays to pass out of the x-ray tube 103. An x-ray housing window 124 is positioned in the x-ray tube housing 102 and is spaced apart from and oppositely positioned to the x-ray tube window 122.

The x-ray housing window 124 is attached in a fluid-tight arrangement to the x-ray tube housing 102 so as to enable the x-rays to pass from the x-ray tube window 122, through the x-ray housing window 124, and exit the x-ray tube housing 102. The x-rays that emanate from the vacuum enclosure 104 and pass through the x-ray housing window 124 may do so substantially as a diverging beam, which is generally used to create x-ray images.

Generally, the features of the x-ray tube housing 102 having the external fins and internal fins to facilitate improved cooling of the fluid coolant 106 and the x-ray tube 103 are described in more detail herein. Also, the fluid coolant 106 can be circulated by passive convective fluid flow or by an active integrated coolant circulation system, as described in more detail herein.

Figure 2A:
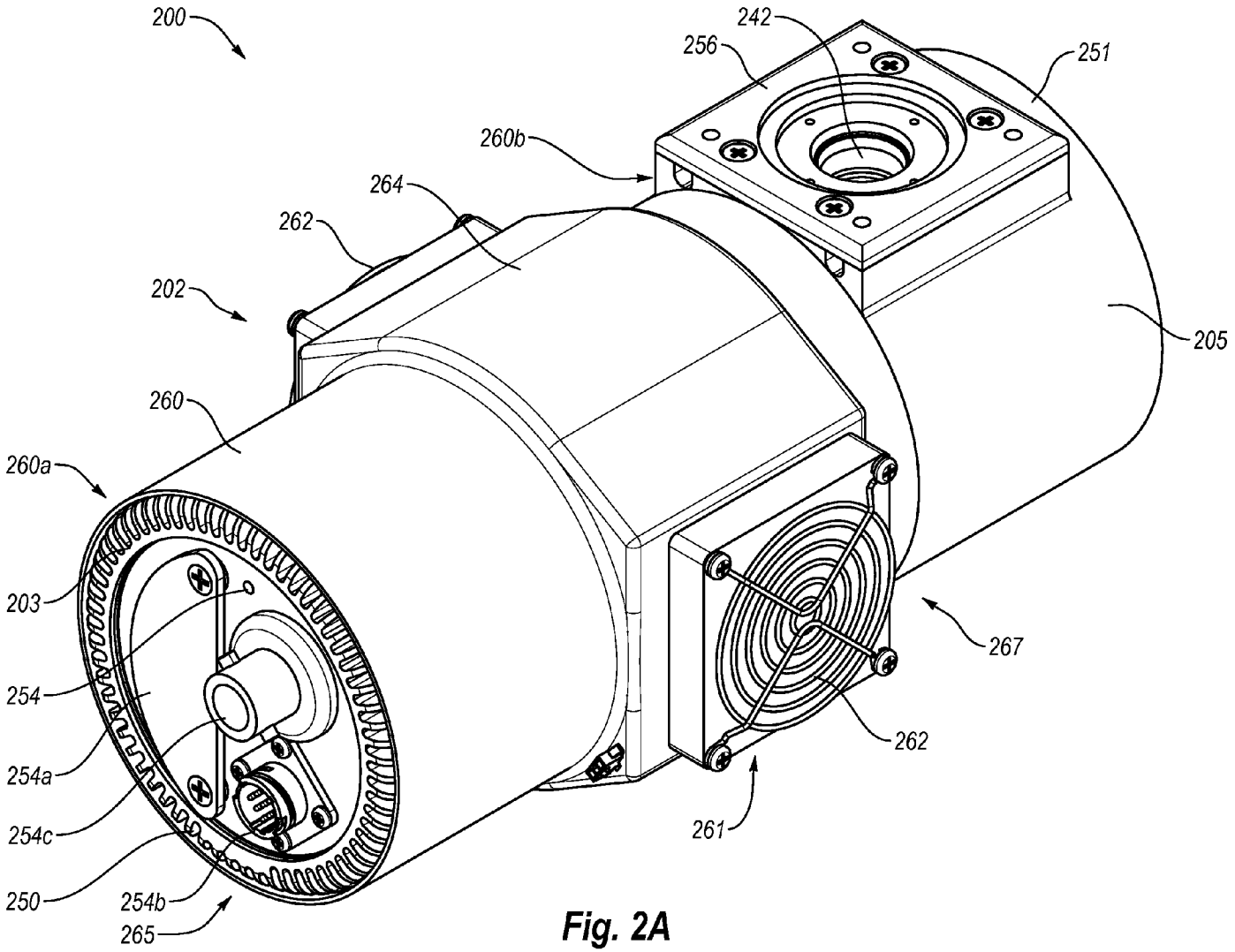
FIG. 2A illustrates a perspective view of an x-ray device.
Figure 2B:
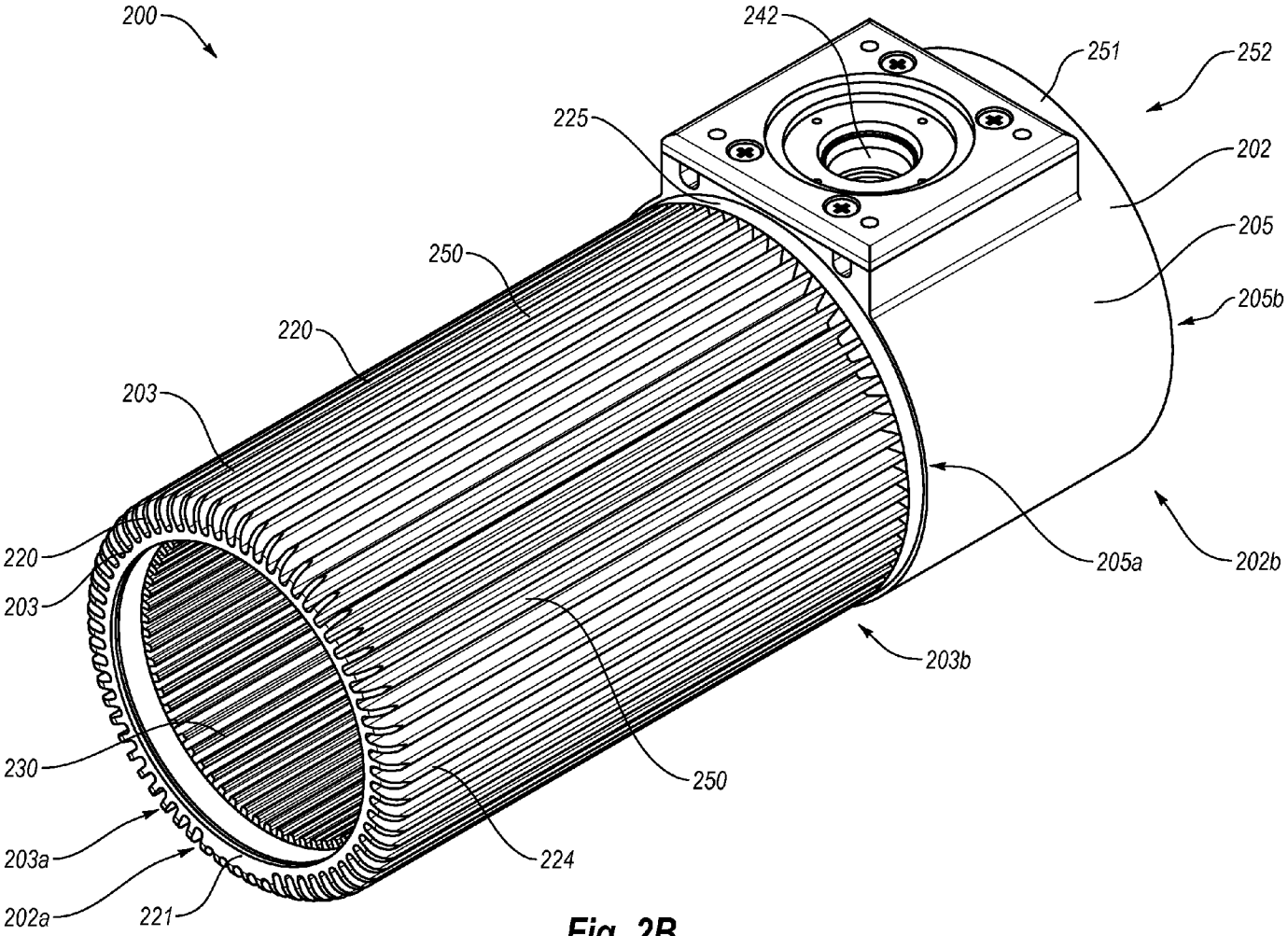
FIG. 2B illustrates a perspective view of an x-ray housing of the x-ray device.

FIGS. 2A-2B show an embodiment of an x-ray device 200 that includes a housing 202 having a first end 202*a* formed by the finned housing 203 and a second end 202*b* formed by the apertured housing 205 joined together. The finned housing 203 includes the external fin array 220 and the internal fin array 230 that are located adjacent to each other and on opposite sides of a finned housing body 250 to improve thermal coupling of the fluid coolant and air. The external fin array 220 extends from about a first end 203*a* of the finned housing 203 to about a second end 203*b* of the finned housing 203. Here, the internal fin array 230 is located on an internal surface of the lumen of the finned housing 203 to define a finned housing lumen 240 (see FIG. 4A), where the internal fin array 230 is shown more clearly and in more detail in subsequent figures. The body 250 of the finned housing 203 defines the external fin array 220 and the finned housing lumen 240 having the internal fin array 230.

The apertured housing 205 may or may not include internal or external fin arrays, and is shown without any fin arrays. However, such internal or external fin arrays of the finned housing 203 can also be applied to the apertured housing 205. The apertured housing includes a body 251 that defines a housing window aperture 242 for emitting x-rays theretherough.

The housing 202 can include a two-piece structure that provides the structures defined therein. The two-piece construction of the housing 202 allows for the finned housing 203 and the apertured housing 205 to be prepared separately, and then joined together, which reduces machining requirements and reduces manufacturing costs. The joining can be by welding, brazing, adhering, or the like, and the two structures may be threaded so that the joining can be by screwing together.

The body 250 of the finned housing 203 can be coupled to a shroud 260 that is adjacent to and radially covers the external fin array 220. The shroud 260 can be in contact with the external fin array 220 or there can be a gap therebetween. The shroud can have an first end 260*a* and a second end 260*b*. The shroud 260 can include one or more fan apertures 261 having fans 262, where two fan apertures 261 having fans 262 are shown. The fans 262 are mounted in a bulged region 264 of the shroud 260. The shroud 260 has an open end 265 and a closed end 267; however, the closed end 267 may be opened in some embodiments to allow air to pass therethrough. The open end 265 is adapted so that the fans 262 blow air into the bulged region 264 and over the external fin array 220 and out of the open end 265 to enhance heat dissipation and cooling of the finned housing 203 as well as the overall housing 202. As such, the shroud 260 is positioned over the external fin array 220 so that the bulged region 264 positions the fans 262 to circulate air through the external fin array 220, which can be by blowing into the external fin array 220 or sucking air therefrom.

Optionally, secondary external fin arrays (not shown) can be included on surfaces of the apertured housing 205, and a shroud with fans may or may not be associated with such secondary external fin arrays.

The apertured housing 205 can be coupled to a cathode cap 252 (see FIG. 1) that covers the internal region of the apertured housing 205 that houses the cathode 110. The finned housing 203 can be coupled to an anode cap 254 that covers the internal region (e.g., the finned housing lumen 240) of the finned housing 203 that houses a fluid coolant reservoir 131 (FIG. 1), a stator 133 (FIG. 1), and other components that facilitate operation of the anode 108. The anode 108, however, can be located in the apertured housing 205 so as to be aligned with the housing window aperture 242. The cathode cap 252 and the anode cap 254 can be coupled to the housing 202 by any suitable means, which can be removable or fixedly coupled (e.g., welded, brazed, adhesive, screw-coupled, mechanically fastened, etc.). The anode cap 254 is shown to have a cavity cover 254*a*, a first electronic port 254*b*, and a second electronic port 254*c*. The cathode cap 252 is shown to have a cathode electronic port 252*a* (FIG. 1).

Also, the apertured housing 205 is shown to have a window housing 256 coupled thereto and around the housing window aperture 242. The window housing 256 is configured to couple a window to the housing window aperture 242.

FIG. 2B shows the housing 202 without the shroud 260 and the anode cap 254 so that the external fin array 220 and the internal fin array 230 can be observed. As shown, the external fin array 220 extends from the first end 203*a* (e.g., anode end) to the second end 203*b* (e.g., end coupled to the apertured housing 205) of the finned housing 203. In the illustrated embodiment, the external fin array 220 includes fins 224 at an annular face 221 of the first end 203*a*. That is, the fins 224 at least partially define the outer region of the annular face 221 of the first end 203*a* with the body 250 defining the middle region, and the internal fin array 230 defining the inner region. The finned housing 203 includes the external fin array 220 extending toward the second end 203*b* to an annular ring 225 that does not have any fins. The annular ring 225 is formed by the body 250 and integrated with the fins 224 of the external fin array 220. As such, the finned housing 203 can be a unitary member. The annular ring 225 at the second 203*b* is coupled to the apertured housing 205. The apertured housing 205 includes a first end 205*a* (e.g., end coupled to the finned housing 203) and an opposite second end 205*b* (e.g., cathode end). The first end 205*a* of the apertured housing 205 is integrally coupled with the second end 203*b* of the finned housing 203. The second end 205*b* of the apertured housing 205 includes the cathode cap 252.

However, the fins 224 of the external fin array 220 may extend all the way to the second end 203*b* and/or the apertured housing 205 in some embodiments.

Figure 3:
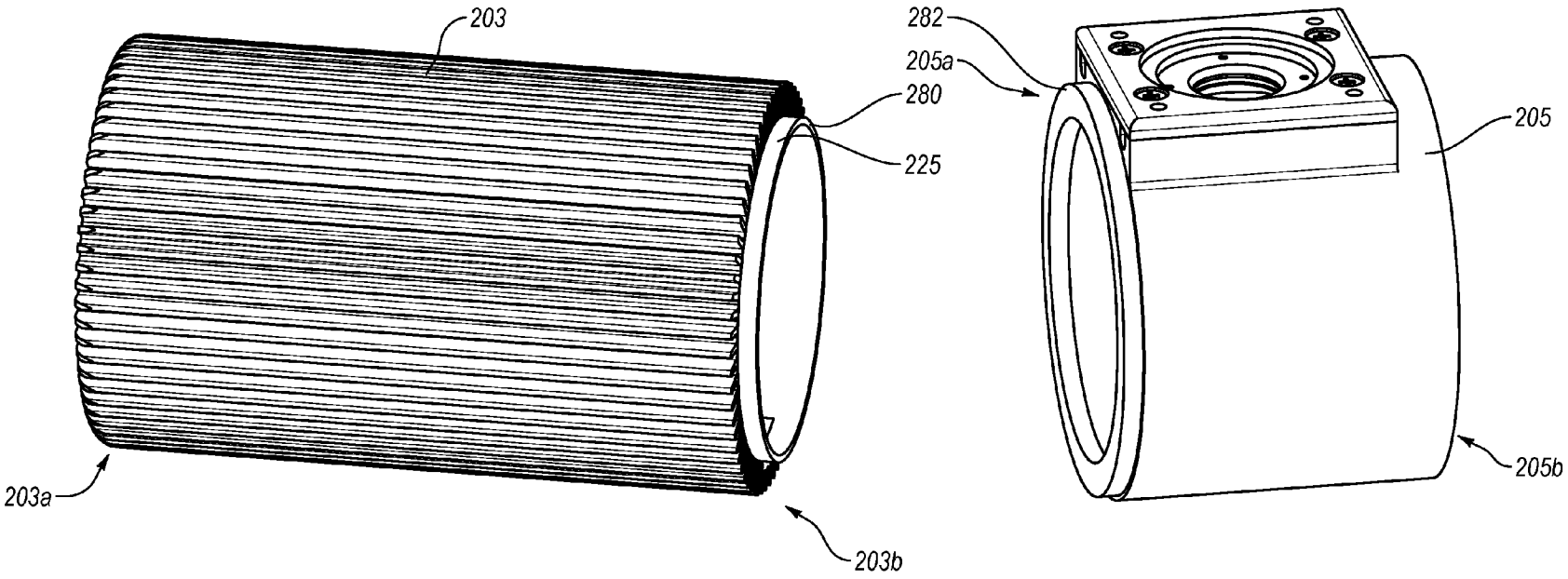
FIG. 3 illustrates the finned housing and apertured housing that are joined to form the x-ray housing.

FIG. 3 illustrates the finned housing 203 separate from the apertured housing 205. As shown, the finned housing 203 has a first end 203*a* and a second end 203*b*, where the second end has an un-finned annular ring 225 and an annular face 280. The apertured housing 205 includes the first end 205*a* and the second end 205*b*, where the first end 205*a* includes an annular face 282. The two annular faces 280, 282 are mated and joined in order to form the housing 202 of FIG. 2B having both the finned housing 203 and the apertured housing 205. The finned housing 203 and apertured housing 205 can be mated and bonded or otherwise affixed together by any means, such as welding, brazing, adhesive, screwing together, or any other means of attachment.

Figure 4A:
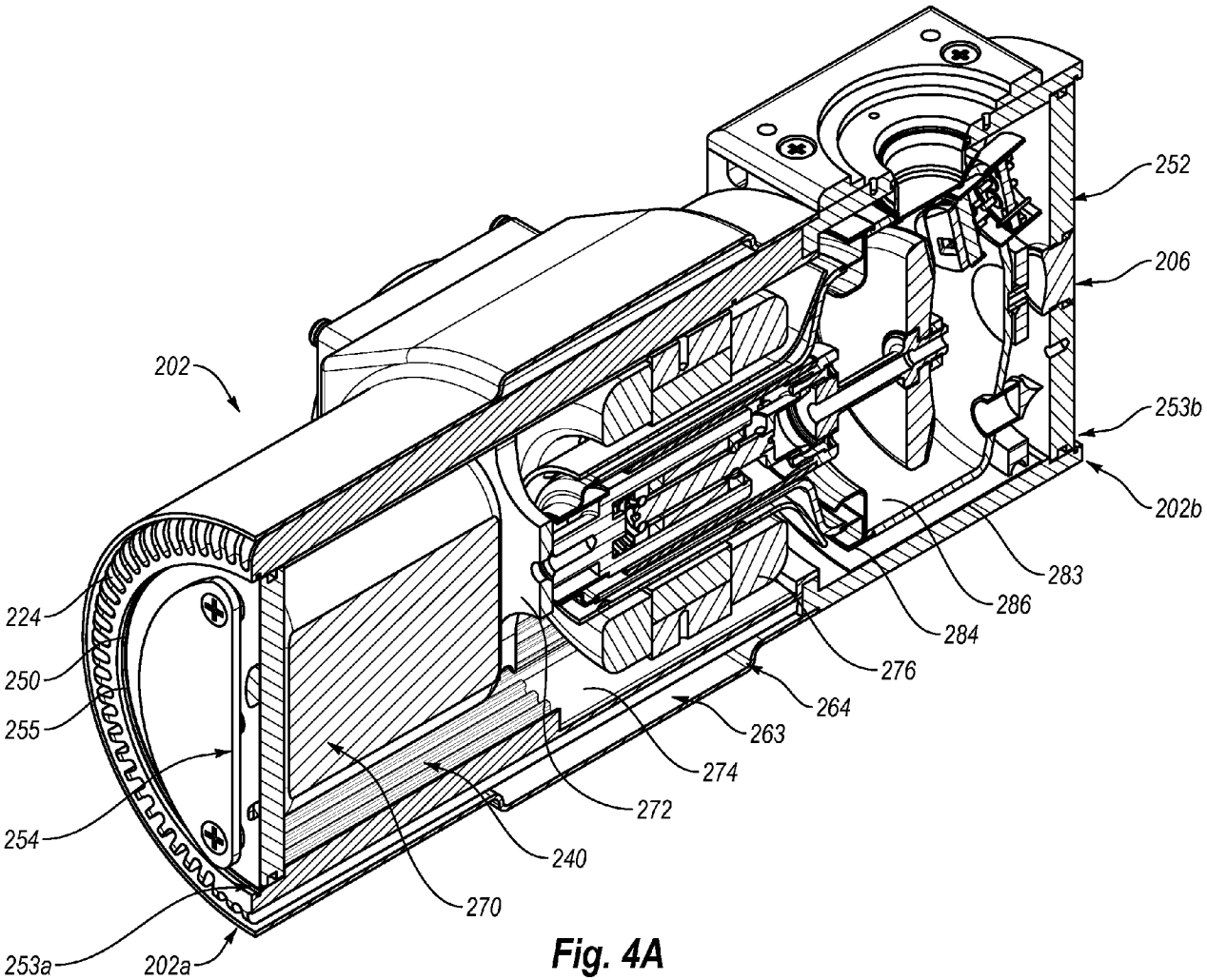
FIGS. 4A-4D illustrate the x-ray device in longitudinal cross-sectional slices.
Figure 4B:
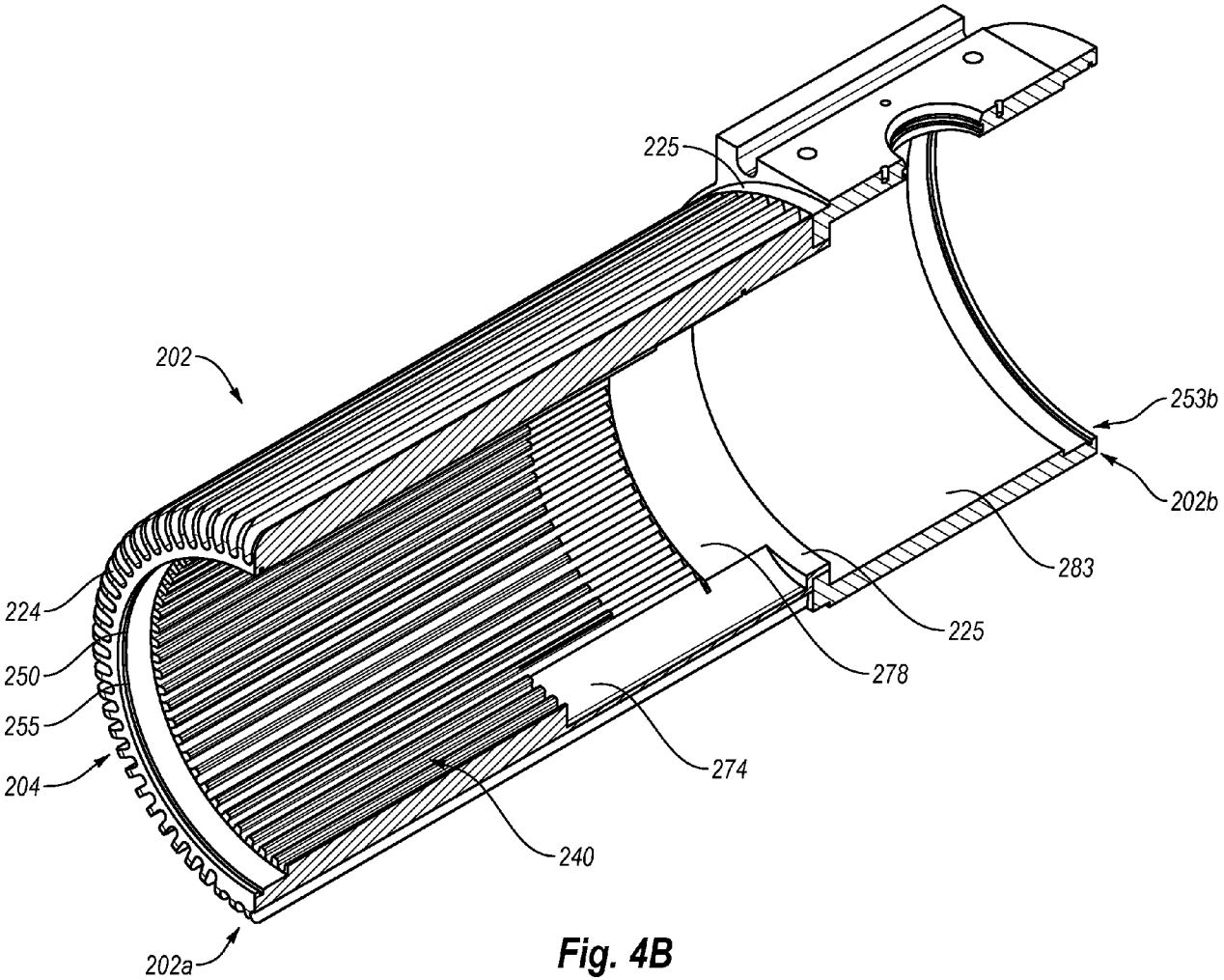
Figure 4C:
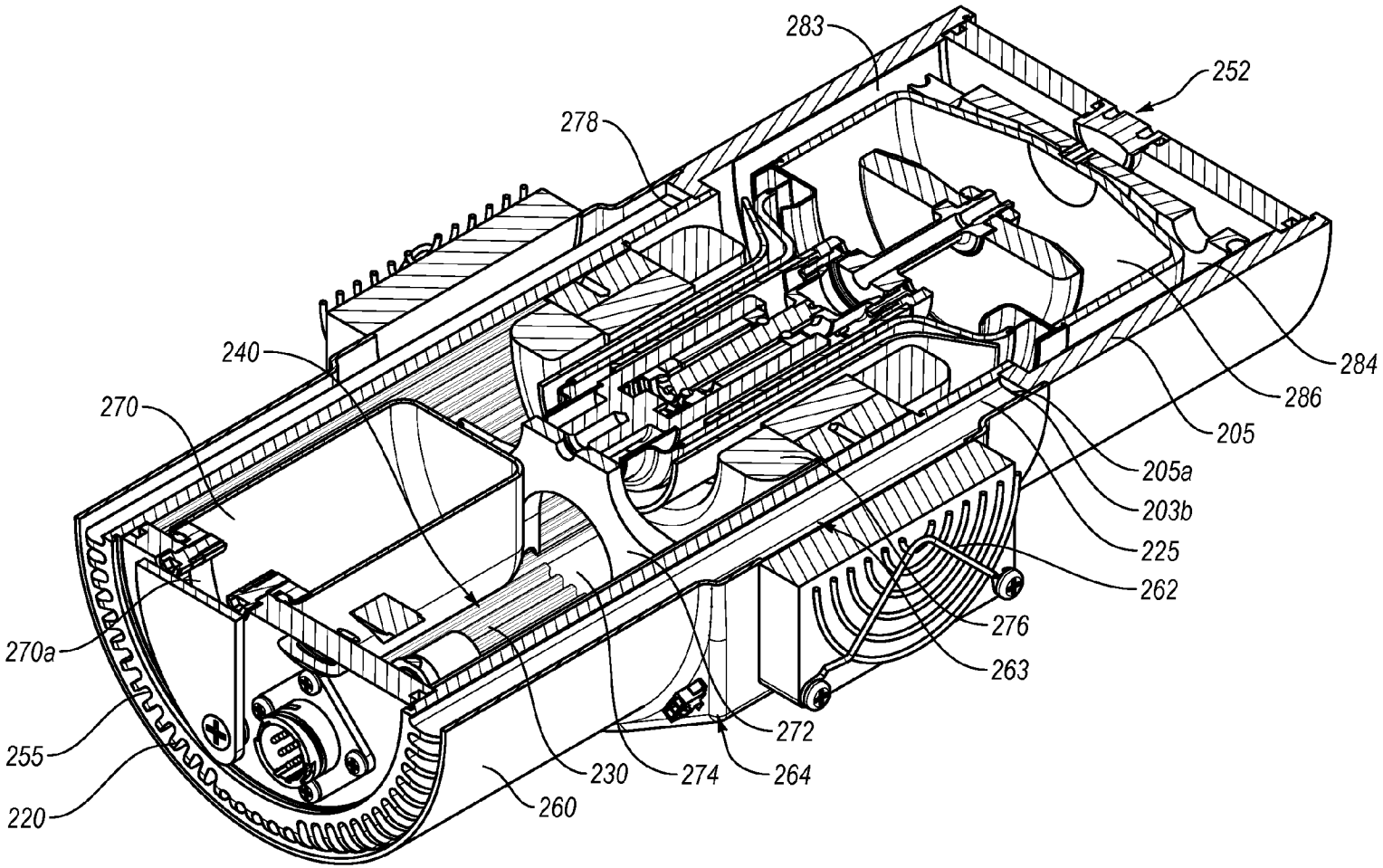
Figure 4D:
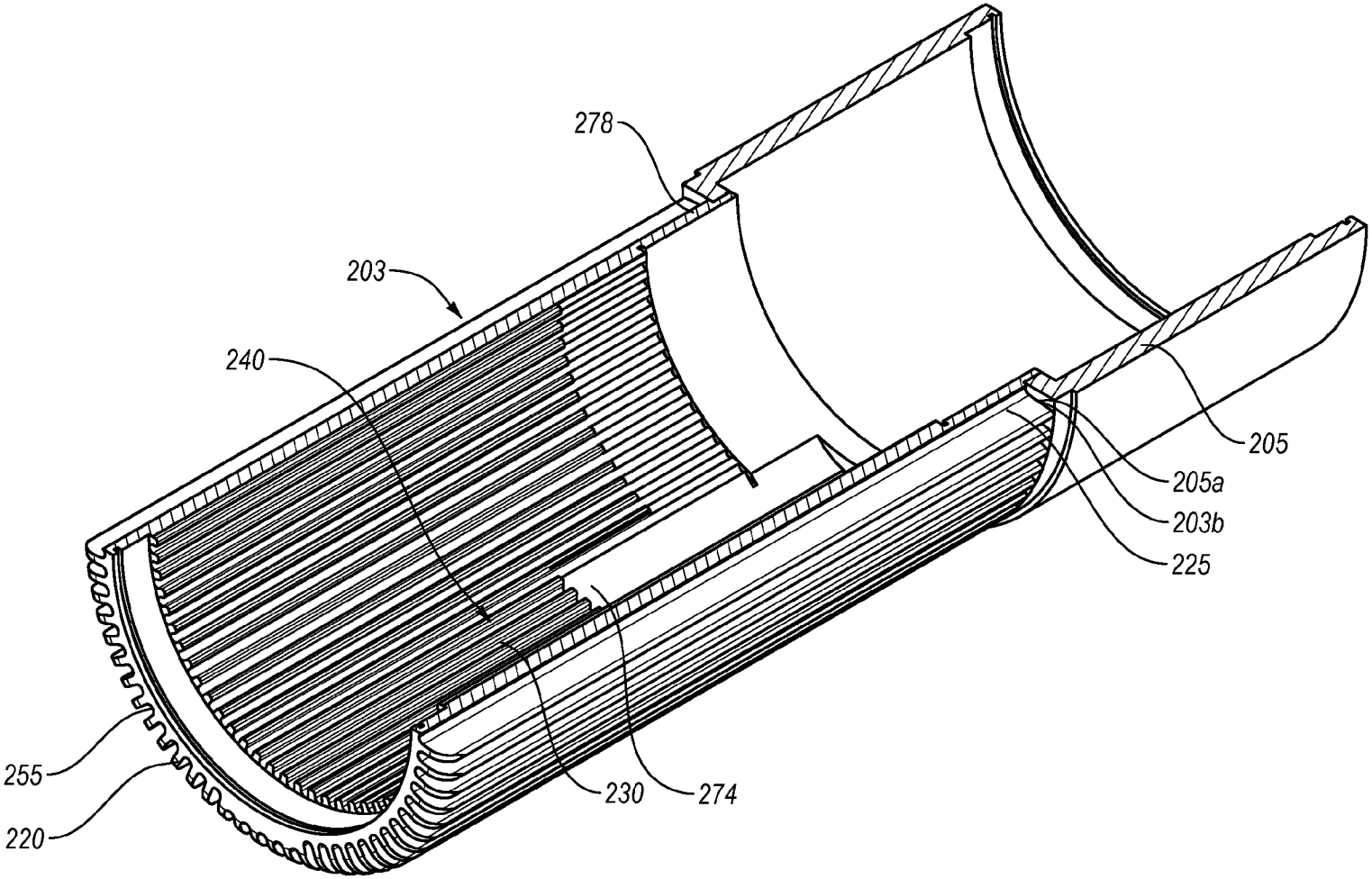

FIGS. 4A-4D include two longitudinal cross-sectional slices, where FIGS. 4A (with internal components) and 4B (without internal components) are X-Y slices, and FIGS. 4C (with internal components) and 4D (without internal components) are corresponding X-Z slices. The housing 202 is illustrated to the first end 202*a* (e.g., anode end) with a first end opening 204 (e.g., anode end opening) covered by the anode cap 254, and the second end 202*b* (e.g., cathode end) with a second end opening 206 (e.g., cathode end opening) having the cathode cap 252.

The figures show the anode cap 254 having a cavity opening 270*a* of a cavity 270. The cavity 270 is separate from the finned housing lumen 240 that is defined by the internal fin array 230 which are opposite of the external fin array 220. A heat exchanger body region 255 includes the external fin array 220 pointed outwardly and the internal fin array 230 pointed inwardly. Also shown is a stator bracket 272 and a stator recess 274, where the stator bracket 272 can be mounted to the internal fin array 230 at an anode end of the stator recess 274. The stator bracket 272 and the stator recess 274 are aligned with the bulged region 264 of the shroud 260 as well as the fans 262, which help cool a stator 276. The figures also show the bulged region 264 having a bulge recess 263 that facilitates air flow and air direction to the external fin array 220 from the fans 262. Also, the fins 224 of the external fin array 220 touch the inside surface of the shroud 260; however, this is optional and there may be a gap therebetween. The stator 276 is in the stator recess 274. The figures show a smooth internal surface 278 that is finless, which is around a portion of the stator recess 247, and which extends from the internal fin array 230 to the second end 203*b* of the finned housing 203. The internal fin array 230 terminates at the smooth internal surface 278. The figures show the second end 203*b* of the finned housing 203 having the annular ring 225 that lacks the external fin array 220 and the internal fin array 230. The annular ring 225 has an outer surface with an outer dimension that matches and frictionally mates an internal surface with an internal dimension of the shroud 260. The figures also show the first end 205*a* of the apertured housing 205 integrally coupled with the second end 203*b* of the finned housing 203, where the annular face 280 of the second end 203*b* of the finned housing 203 is integrally coupled with the annular face 282 of the first end 205*a* of the apertured housing 205 (see FIG. 3). The annular face 282 is thicker than the annular face 280 so that there is a step from the finned housing lumen 240 to an apertured housing lumen 284. The figures show the apertured housing lumen 284 defined by a smooth internal surface 283 including a vacuum enclosure 286 containing the anode 288. The figures also show that the anode cap 254 is positioned within an anode end cap recess 253*a* at the first end 202*a*, and the cathode cap 252 is positioned within a cathode end cap recess 253*b* at the second end 202*b*.

Figure 5A:
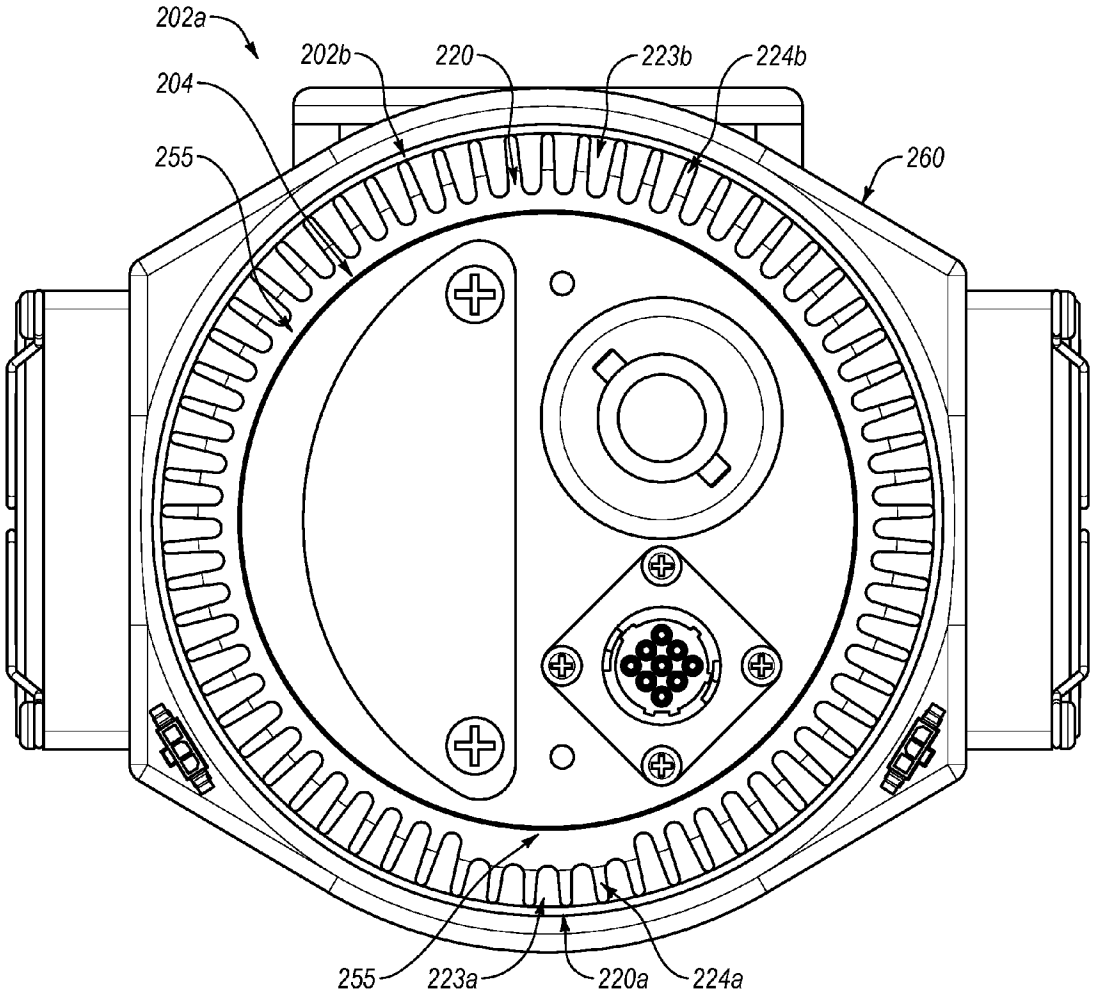
FIG. 5A illustrates an end view of a first end of the x-ray device.
Figure 5B:
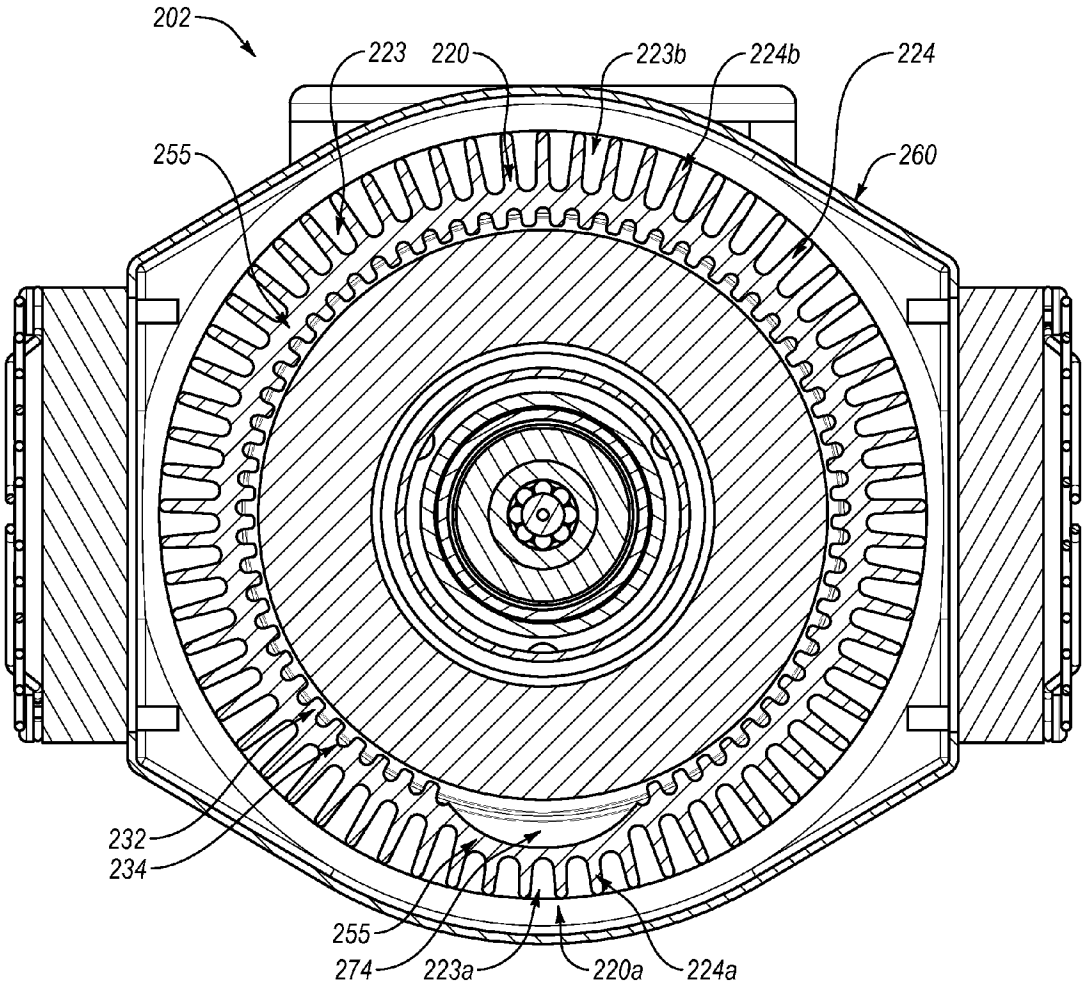
FIG. 5B illustrates a lateral cross-sectional view of the x-ray device.

FIG. 5A shows the first end 202*a* having the first end opening 204 with the finned housing 203 showing from the shroud 260. The external fin array 220 provides an air conduit with the shroud 260. Also shown is that the external fin array 220 includes a shallow external fin array 220*a* and a deep external fin array 220*b*. The shallow external fin array 220*a* is longitudinally aligned with the stator recess 274, and can have the same circumferential dimensions thereof. The heat exchanger body region 255 is thicker at the shallow external fin array 220*a*. As such, the shallow external fin array 220*a* includes short fins 224*a* and shallow fin recesses 223*a*, and the deep external fin array 220*b* includes long fins 224*b* and deep fin recesses 223*b*. FIG. 5B shows a cross-sectional profile at the stator recess 274, where the heat exchanger body region 255 is thinner. FIG. 5B also shows internal fins 232 and internal fin recesses 234 of the internal fin array 230. Here, it is shown that the stator recess 274 is devoid of the internal fins 232. Also, the stator recess 274 is deeper than the internal fin recesses 234. Additionally, it is shown that the external fins 224 (e.g., 224*a*, 224*b*) are longer than the internal fins 232, with the external fin recesses (223*a*, 223*b*) being deeper than the internal fin recesses 234. It is also shown that the external fin 224 is aligned with the internal fin recess 234 and an external fin recess 223 is aligned with the internal fin 232; however, this can be modified or switched so fins align with fins, or they may be offset from each other. Here, the number of the external fins 224 and the internal fins 232 are the same, but the numbers may vary and be different from each other.

In one embodiment, an x-ray housing can include a finned housing member having a tubular body with an external fin array on a finned external surface and an internal fin array on a finned internal surface. The finned internal surface can define a finned housing lumen. The internal fin array and external fin array can cooperatively form a heat exchanger. The x-ray housing can include an apertured housing member having a tubular body with an x-ray window aperture extending therethrough from an external surface to an internal surface. The internal surface can define an apertured housing lumen. The finned housing member can have an annular end integrally coupled with an annular end of the apertured housing member to form a tubular x-ray housing having an x-ray housing lumen. In one aspect, the external fin array extends from a first end of the finned housing to a second end of the finned housing. In one aspect, the external fin array extends around a circumference of the finned housing. In one aspect, the external fin array covers the finned external surface between the first end and second end with a plurality of external fins separated by a plurality of external fin recesses. In one aspect, the external fins and fin recesses extend from the first end to an annular ring at the second end of the finned housing. In one aspect, the internal fin array extends from the first end of the finned housing to the second end of the finned housing. In one aspect, the internal fin array extends around the circumference of the finned housing. In one aspect, the internal fin array covers the finned internal surface between the first end and second end with a plurality of internal fins separated by a plurality of internal finned recesses. In one aspect, the internal fins and fin recesses extend from the first end to a smooth annular surface of the second end of the finned housing. The annular ring can be a cross-section of the finned housing at the second end that does not have external or internal fins, or it can be devoid of internal fins.

In one embodiment, a stator recess is located on the finned internal surface, where the stator recess can be devoid of internal fins and fin recesses. However, the stator recess may include fins and fin recesses in some embodiments. In one aspect, the stator recess can extend from a second end or annular ring of the finned housing to a location between the first end and second end of the finned housing. In one aspect, the stator recess can extend from a second end or annular ring of the finned housing to a stator bracket mounted to the finned internal surface between the first end and second end of the finned housing. In one aspect, the stator recess has a "C" shaped cross-section. In one aspect, the stator recess has a trough into the finned housing that has a depth that is the same or deeper than the internal fin recesses. In one aspect, a plurality of internal fins and fin recesses extend from the first end of the finned housing to a stator recess on the finned internal surface.

In one embodiment, the finned housing can include an end cap recess at the first end on the finned internal surface between a first end annular face and the internal fin array, the end cap recess being devoid of internal fins and fin recesses and having an end cap located in the end cap recess. In one aspect, the internal fin array can extend from the end cap recess to the second end. The first end can include the end cap recess.

In one embodiment, the external fins of the external fin array are aligned with internal fins of the internal fin array.

In one embodiment, the external fins of the external fin array are aligned with internal fin recesses of the internal fin array.

In one embodiment, the second end of the finned internal surface has an annular non-finned region or annular smooth surface between the internal fin array and the second end annular face. In one aspect, the finned internal surface can have an annular non-finned region or annular smooth surface between the stator recess and the second end annular face. In one aspect, the stator recess can be positioned partially in the internal fin array and partially in an annular non-finned region or annular smooth surface adjacent to the second end annular face.

In one embodiment, the finned external surface can have an annular non-finned region (e.g., annular ring) between the external fin array and the second end annular face. In one aspect, the finned housing can include a non-finned annular region at the second end and having the second end annular face. In one aspect, the finned housing comprising the second end annular face is coupled with the apertured housing.

In one embodiment, the apertured housing is devoid of a fin array. In one aspect, the apertured housing is devoid of an internal fin array. In one aspect, the apertured housing is devoid of an external fin array.

In one embodiment, the apertured housing includes a fin array. In one aspect, the apertured housing includes an internal fin array. In one aspect, the apertured housing includes an external fin array.

In one embodiment, a second end annular face of the finned housing is integrally coupled with a third annular face of the apertured housing. In one aspect, the second end annular face of the finned housing has a larger dimension than the third annular face of the apertured housing. In one aspect, the apertured housing has a fourth end opposite of the third end, the fourth end having an end cap recess. In one embodiment, the apertured housing has an end cap in the end cap recess.

In one embodiment, a first plurality of the external fin recesses can have shallower depths compared to a second plurality of the external fin recesses. In one aspect, the first plurality of external fin recesses can be longitudinally aligned with a stator recess. In one aspect, the first plurality of the external fin recesses form a shallow external fin array of the external fin array and the second plurality of the external fin recesses form a deep external fin array. In one aspect, the shallow external fin array includes about 5-20 shallow external fin recesses. In one aspect, the deep external fin array includes 40 to 80 deep external fin recesses. In one aspect, the shallow external fin recesses are about 5% to about 35% of the fin recesses. In one aspect, the external fin array includes about 65 fins+/−20%, 15%, 10%, 5%, or 1%. In one aspect, the internal fin array includes about 65 fins+/−20%, 15%, 10%, 5%, or 1%.

In one embodiment, there is a shroud covering the finned housing. The shroud can include one or more fan apertures. In one aspect, each fin aperture can include a fan. The one or more fan apertures can be circumferentially aligned, although they do not have to be aligned. In one aspect, the shroud can have a radially bulged region having the one or more fan apertures. In one aspect, the radially bulged region can form an air conduit recess on an internal surface of the shroud. In one aspect, the air conduit recess is defined by the radially bulged region on the internal surface of the shroud and a region of the external fin array of the finned housing adjacent thereto.

In one embodiment, an x-ray device can include x-ray housing as described herein and an x-ray tube insert located in the x-ray housing lumen. In one aspect, the x-ray tube insert can include an anode and cathode located in the apertured housing lumen. In one aspect, the anode is aligned with the x-ray window aperture. In one aspect, an x-ray window is located in the x-ray window aperture. In one aspect, the x-ray tube insert can include a stator in the finned aperture lumen. In one aspect, the stator can be aligned with a radially bulged region of the shroud. In one aspect, the x-ray tube insert can be devoid of a coolant fluid pump. In one aspect, the x-ray tube insert can include a coolant fluid pump. In one aspect, the x-ray housing can include a coolant fluid reservoir at least partially defined by the internal fin array and x-ray insert. In one aspect, a coolant fluid can be in the coolant fluid reservoir. In one aspect, the coolant fluid reservoir is devoid of a gas, such as air.

In one embodiment, a method of cooling the x-ray device can include operating one or more fans in the shroud to blow air over the external fin array so that heat from coolant fluid transfers through the internal fin array through the finned housing and is blown by the air away from the x-ray device to dissipate at least 250 watts of heat. The method can include dissipating at least 300 watts of heat. The method can include dissipating at least 400 watts of heat.

In one embodiment, the external and/or internal fins can vary in quantity, size, and geometries.

In one embodiment, the shroud can be excluded and the fans can be mounted with a mounting bracket or mounting plate.

In one embodiment, the finned housing can include an integrated oil pump mounted in the finned housing lumen. For example, the cavity 270 illustrated in the finned housing lumen can be the integrated oil pump.

In one embodiment, the external and internal fin arrays can be used to manage heat loading between media on the mammography x-ray tube. The x-ray housing can use a two-piece housing approach (e.g., finned housing coupled to apertured housing) where the two pieces are integrally coupled together. The two pieces can be welded, brazed, adhered, screwed together, or otherwise mechanically joined.

In one embodiment, the design of the shroud and fans can be modified to fit into existing x-ray machines, such as mammography x-ray machines.

The x-ray device having the finned housing described herein was tested for heat dissipation characteristics. As such, thermocouples (TC) were placed at locations during operational testing, which included the cathode TC, anode TC, cathode oil TC, anode oil TC, and center TC. The x-ray device was operated to produce x-rays to determine operational parameters, including cooling potential during operation. The x-ray housing was operated to determine if the final housing and fanned shroud could dissipate heat, such as 300 watts continuously. The x-ray device was operated in a Selina dimensioned mammography x-ray machine and tested for temperature control and cooling, system fit, and radiation leakage. Here, the x-ray device included the finned housing with 65 external fins and 65 internal fins contained in the fanned shrouding with two oppositely disposed cooling fans (e.g., 12 VDC) located at about the stator location.

Figure 6A:
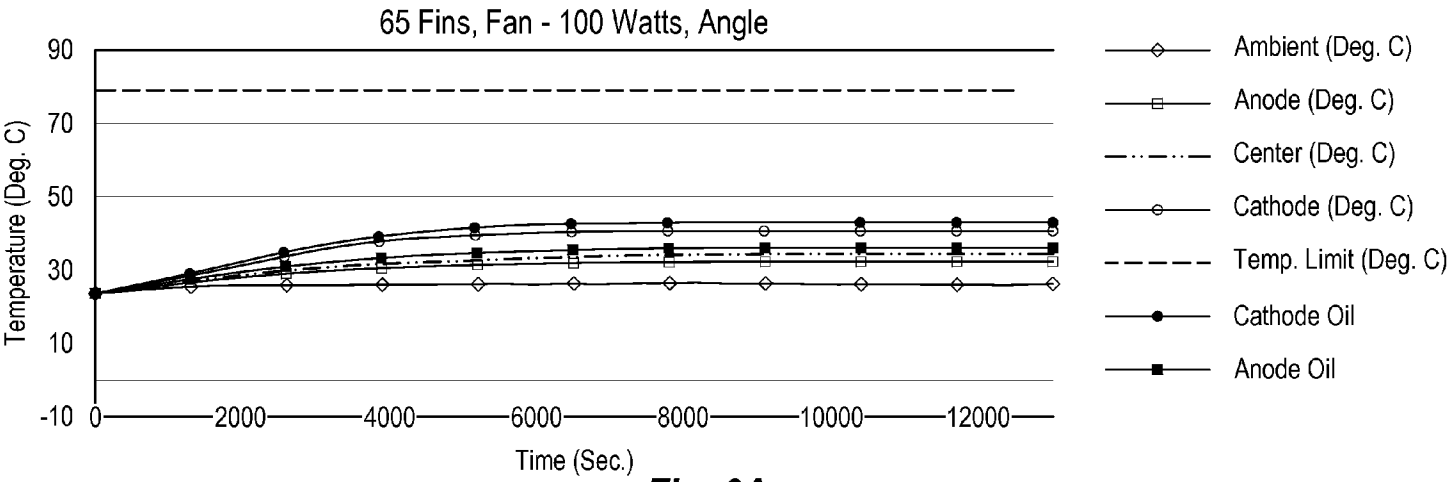
FIG. 6A includes a graph that illustrates temperature data for 100 watts for an x-ray device having 65 fins.
Figure 6B:
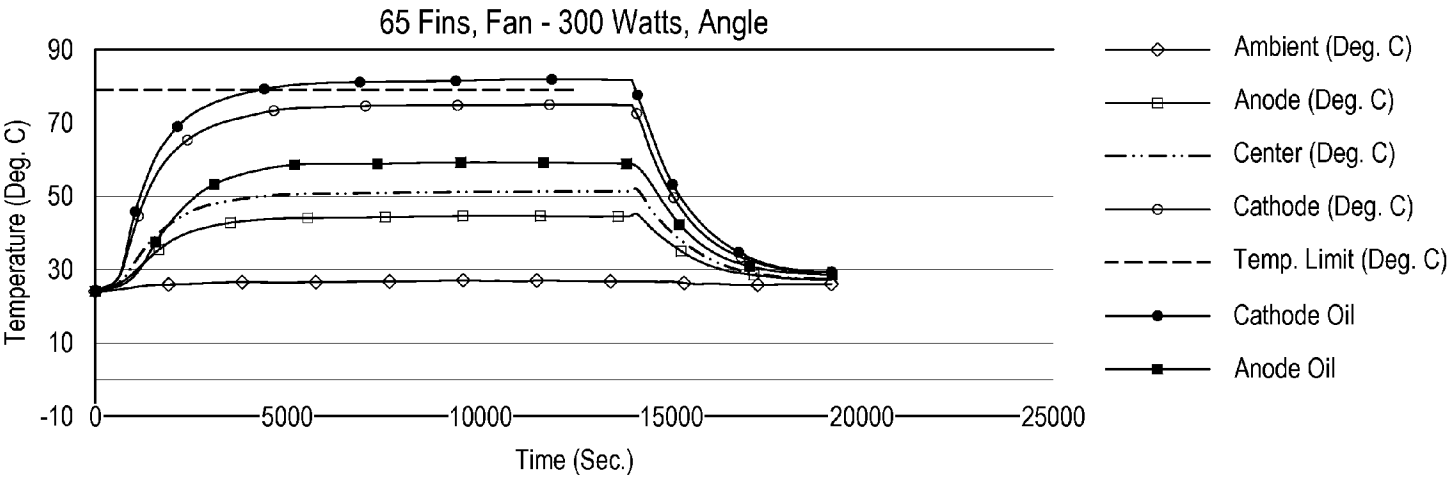
FIG. 6B includes a graph that illustrates temperature data for 300 watts for the x-ray device having 65 fins.

The heating and cooling was characterized at 100-, 300-, and 400-watt power, including filament, stator, and x-ray tube power. The equipment setup was: tube angle at about 6 degrees; about 25° C. ambient temperature; the placement of thermocouples as shown and described; and operation of the fans. FIG. 6A shows the data for heating and cooling curves for 100 watts, and FIG. 6B shows the data for 300 watts. This shows the x-ray device was able to cool 300 watts to obtain the steady state operating conditions with the temperatures shown, which are within acceptable temperature limits.

The x-ray device was placed into the Selinia dimensioned machine and checked for: clearance to ensure the x-ray device fit freely into the tube head structure; cable length to connect the feed-through and high voltage connector; and operation to capture x-ray images. The x-ray device was tested for radiation leakage, where no radiation leakage was found. The radiation leakage testing criteria included: 40 kV; 8 mA; and 300 seconds, with acceptance criteria being less than 50 mR/hr. Here, there was no lead shielding, and there was only 22 mR/Hr radiation leakage rate, which is acceptable. It is expected that 2 mR/Hr radiation leakage can be obtain with a standardized machine based on this prototype.

Figure 6C:
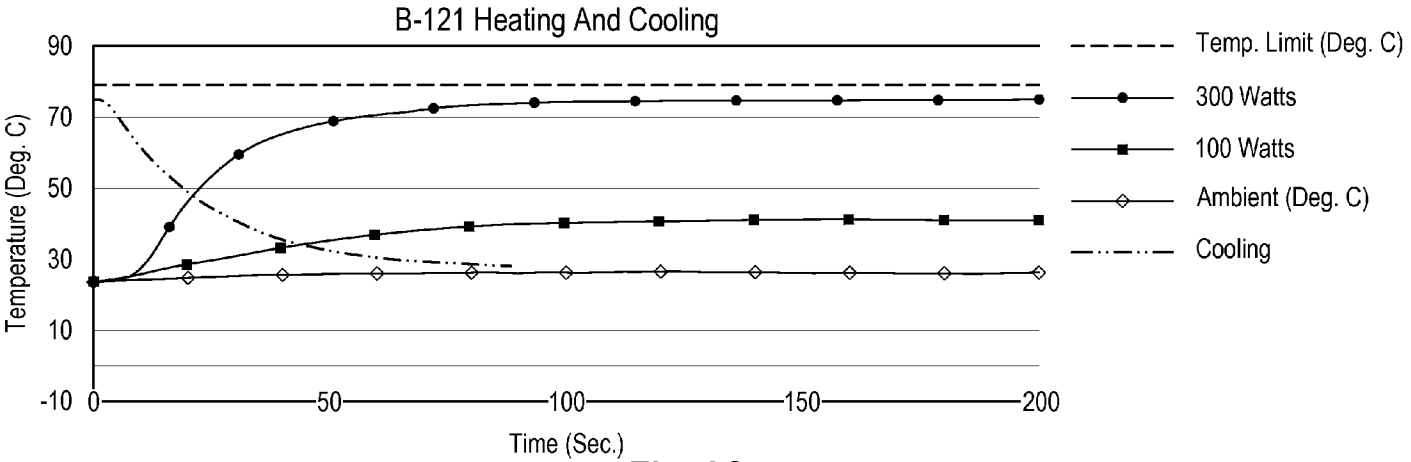
FIG. 6C includes a graph that illustrates temperature data for an x-ray device at 100 watts, 300 watts, and cooling.

FIG. 6C shows the B121 heating and cooling curves, where it is noted that the 300-watt operation and heat dissipation provides a temperature less than the temperature limit. Thus, the x-ray device can be considered to be rated for at least 300-watt operation and heat dissipation.

Figure 6D:
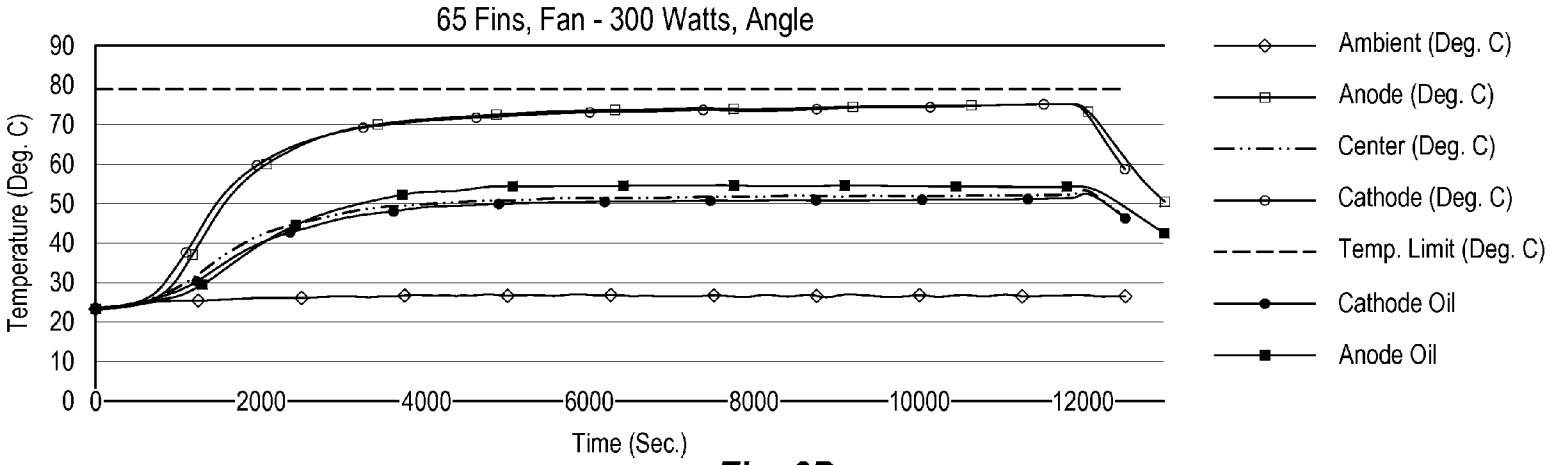
FIG. 6D includes a graph that illustrates temperature data for 300 watts for the x-ray device having 65 fins.

FIG. 6D shows another run of the heating and cooling curves for 300 watts, where the steady state anode and cathode temperatures are maintained below the 80° C. temperature limit.

Figure 6E:
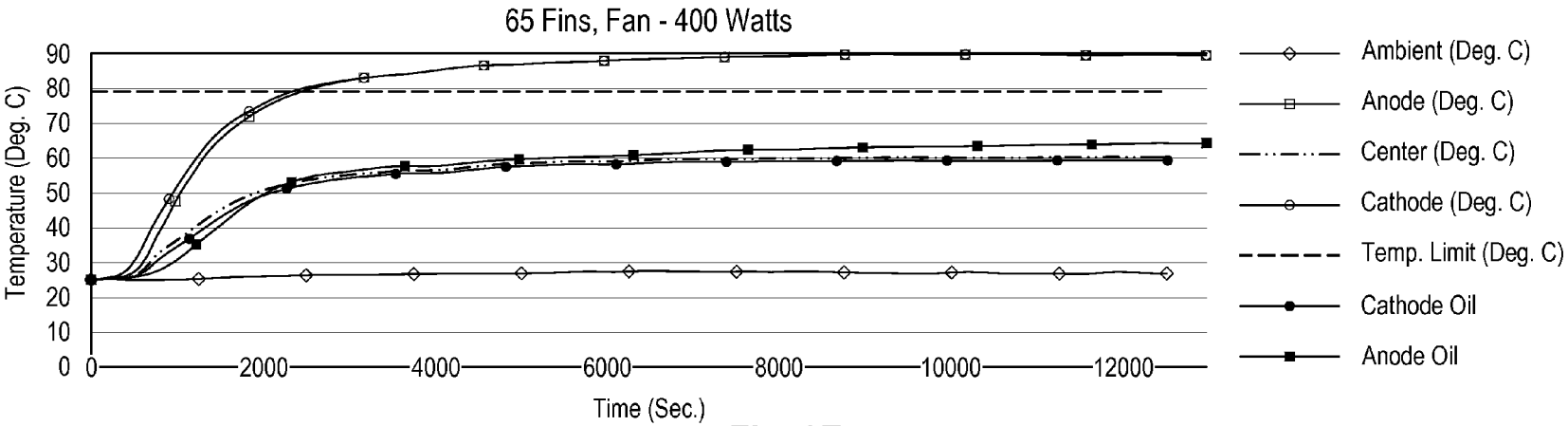
FIG. 6E includes a graph that illustrates temperature data for 400 watts for the x-ray device having 65 fins.

FIG. 6E shows another run of the heating and cooling curves for 400 watts, where the steady state anode and cathode temperatures are above the 80° C. temperature limit, but at 90° C. can be acceptable during common usage.

Figure 6F:
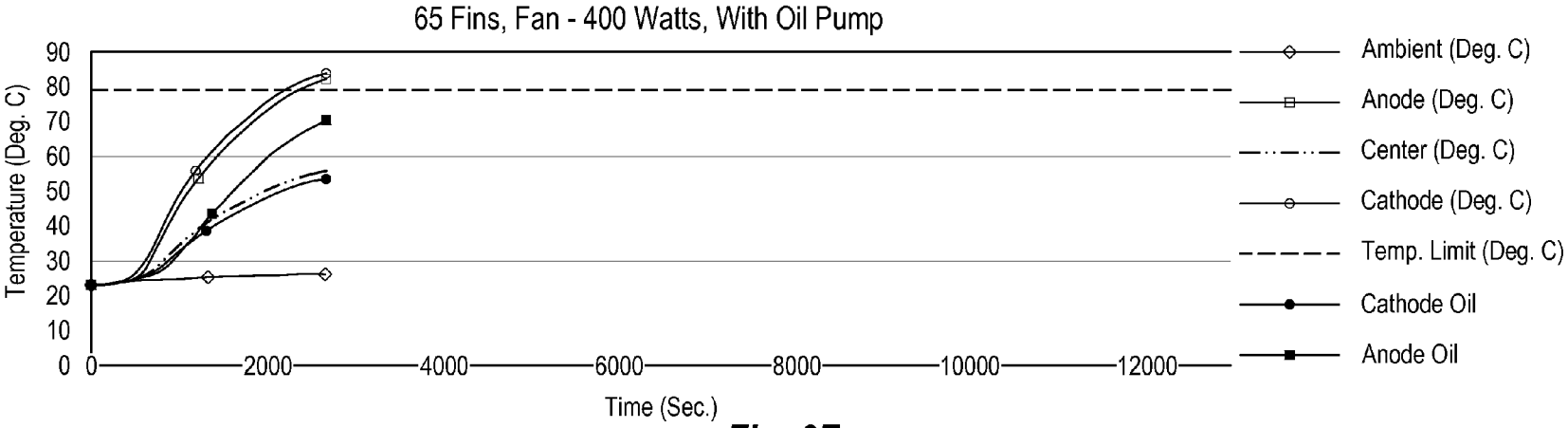
FIG. 6F includes a graph that illustrates temperature data for 300 watts for the x-ray device having 65 fins with an internal oil pump.

FIG. 6F shows another run of the heating and cooling curves for 400 watts with an internal oil pump in the finned housing lumen, where the anode and cathode temperatures are above the 80° C. temperature limit, but at 90° C. can be acceptable during common usage. This shows that the x-ray device without the internal oil pump can have efficient cooling, and the oil pump can be optional.

The x-ray housing can have various dimensions; however, it can be configured to fit into and be used with mammography x-ray machines. The x-ray housing can have the following specifications: The heat dissipation can result in a maximum housing temperature of about 78-80 degrees C.+/−4 degrees C. The diameter of the housing can be about 5.5 inches (e.g., 5.44 inches). The window aperture frame can be about 3.5 inches by 3.5 inches. The length of the housing can be about 13 inches. These dimensions can vary, and are provided as examples. For example, these dimensions can range up to about 33%, 25%, 20%, 15%, 10%, 5%, 2.5%, or 1%.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

All references recited herein are incorporated herein by specific reference in their entirety.

The invention claimed is:

1. An x-ray housing comprising:

a finned housing member having a tubular body with an external fin array on a finned external surface and an internal fin array on a finned internal surface, the finned internal surface defining a finned housing lumen, the internal fin array and external fin array cooperatively forming a heat exchanger, wherein the internal fin array covers the finned internal surface between the first end and an un-finned stator recess and an un-finned annular region at a second end with a plurality of internal fins separated by a plurality of internal finned recesses; and an apertured housing member having a tubular body with an x-ray window aperture extending therethrough from an external surface to an internal surface, the internal surface defining an apertured housing lumen, the finned housing member having an annular end integrally coupled with an annular end of the apertured housing member to form a tubular x-ray housing having an x-ray housing lumen formed from the finned housing lumen and apertured housing lumen.

2. The x-ray housing of claim 1, wherein:

the external fin array covers the finned external surface between a first end and an un-finned annular region at a second end with a plurality of external fins separated by a plurality of external fin recesses.

3. The x-ray housing of claim 1, comprising the stator recess extending from the un-finned annular region at the second end of the finned housing to a stator bracket mounted to the finned internal surface between the first end and second end of the finned housing, wherein the stator recess has a trough into the finned housing that has a depth that is the same or deeper than internal fin recesses of the internal fin array.

4. The x-ray housing of claim 1, the finned housing comprising an end cap recess at the first end on the finned internal surface between a first end annular face and the internal fin array, the end cap recess being devoid of internal fins and fin recesses and having an end cap located in the end cap recess.

5. The x-ray housing of claim 1, comprising the stator recess positioned partially in the internal fin array and partially in the un-finned annular region at the second end.

6. The x-ray housing of claim 1, wherein the apertured housing is devoid of a fin array.

7. The x-ray housing of claim 4, wherein a second end annular face of the finned housing is integrally coupled with a third end annular face of the apertured housing, wherein the second end annular face of the finned housing has a larger dimension than the third end annular face of the apertured housing.

8. The x-ray housing of claim 7, the apertured housing having a fourth end opposite of the third end, the fourth end having an end cap recess.

9. The x-ray housing of claim 2, wherein a first plurality of the external fin recesses have shallower depths compared to a second plurality of the external fin recesses, the first plurality of external fin recesses being longitudinally aligned with the stator recess.

10. The x-ray housing of claim 9, wherein the shallow external fin recesses are about 5% to about 35% of the external fin recesses.

11. The x-ray housing of claim 1, comprising a shroud covering the finned housing.

12. The x-ray housing of claim 11, wherein the shroud includes one or more fan apertures, each fan aperture including a fan.

13. The x-ray housing of claim 12, the shroud having a radially bulged region having the one or more fan apertures.

14. The x-ray housing of claim 13, wherein the radially bulged region forms an air conduit recess on an internal surface of the shroud.

15. An x-ray device comprising:

an x-ray housing comprising:

a finned housing member having a tubular body with an external fin array on a finned external surface and an internal fin array on a finned internal surface, the finned internal surface defining a finned housing lumen, the internal fin array and external fin array cooperatively forming a heat exchanger, wherein the internal fin array covers the finned internal surface between the first end and an un-finned stator recess and an un-finned annular region at a second end with a plurality of internal fins separated by a plurality of internal finned recesses; and an apertured housing member having a tubular body with an x-ray window aperture extending therethrough from an external surface to an internal surface, the internal surface defining an apertured housing lumen, the finned housing member having an annular end integrally coupled with an annular end of the apertured housing member to form a tubular x-ray housing having an x-ray housing lumen formed from the finned housing lumen and apertured housing lumen; and an x-ray tube having an anode and cathode located in the x-ray housing lumen, the x-ray tube having an x-ray window aligned with the x-ray window aperture of the apertured housing.

16. The x-ray device of claim 15, wherein:

the external fin array covers the finned external surface between a first end and an un-finned annular region at a second end with a plurality of external fins separated by a plurality of external fin recesses.

17. The x-ray device of claim 16, wherein a first plurality of the external fin recesses have shallower depths compared to a second plurality of the external fin recesses, the first plurality of external fin recesses being longitudinally aligned with the stator recess.

18. The x-ray device of claim 15, comprising a shroud covering the finned housing, wherein the shroud includes a radially bulged region having one or more fan apertures, each fin aperture including a fan.

19. The x-ray device of claim 15, comprising a fluid coolant in the x-ray housing lumen between the x-ray tube and the internal fin array so as to be in contact therewith.

20. A method of cooling an x-ray device, the method comprising:

operating x-ray device having an x-ray housing and an x-ray tube having an anode and cathode located in a lumen of the x-ray housing, the x-ray housing comprising:

a finned housing member having a tubular body with an external fin array on a finned external surface and an internal fin array on a finned internal surface, the finned internal surface defining a finned housing lumen, the internal fin array and external fin array cooperatively forming a heat exchanger, wherein the internal fin array covers the finned internal surface between the first end and an un-finned stator recess and an un-finned annular region at a second end with a plurality of internal fins separated by a plurality of internal finned recesses;

an apertured housing member having a tubular body with an x-ray window aperture extending therethrough from an external surface to an internal surface, the internal surface defining an apertured housing lumen, the finned housing member having an annular end integrally coupled with an annular end of the apertured housing member to form a tubular x-ray housing having an x-ray housing lumen formed from the finned housing lumen and apertured housing lumen;

a fluid coolant in the x-ray housing lumen between the x-ray tube and the internal fin array so as to be in contact therewith; and a shroud covering the finned housing, wherein the shroud includes a radially bulged region having one or more fan apertures, each fin aperture including a fan; and operating one or more of the fans in the shroud to blow air over the external fin array so that heat from the fluid coolant in the x-ray housing lumen transfers through the internal fin array through the finned housing to the external fin array and is blown by the air away from the x-ray device to dissipate at least 250 watts of heat.

21. The method of claim 20, comprising dissipating at least 300 watts of heat.

* * * * *